United States Patent [19]

Westerman

[11] Patent Number: 4,518,967

[45] Date of Patent: May 21, 1985

[54] TAPERED-WIDTH LEAKY-WAVEGUIDE ANTENNA

[75] Inventor: Charles W. Westerman, El Toro, Calif.

[73] Assignee: Ford Aerospace & Communications Corporation, Detroit, Mich.

[21] Appl. No.: 354,992

[22] Filed: Mar. 5, 1982

[51] Int. Cl.[3] ..... H01Q 13/20

[52] U.S. Cl. ..... 343/771; 343/770

[58] Field of Search ..... 343/767-771

[56] References Cited

U.S. PATENT DOCUMENTS

| | | | |
|---|---|---|---|
| 2,447,549 | 8/1948 | Willoughby | 343/771 |
| 2,648,839 | 8/1953 | Ford et al. | 343/771 |
| 2,840,818 | 6/1958 | Reed et al. | 343/770 |
| 2,894,261 | 7/1959 | Yaru | 343/771 |
| 2,981,949 | 4/1961 | Elliott | 343/770 |
| 3,213,454 | 10/1965 | Ringenbach | 343/771 |
| 3,218,644 | 11/1965 | Berry | 343/770 |
| 3,500,251 | 3/1970 | Peace | 343/771 |
| 3,530,478 | 9/1970 | Corzine et al. | 343/771 |
| 3,568,208 | 3/1971 | Hatcher | 343/771 |
| 3,633,207 | 1/1972 | Ingerson et al. | 343/770 |
| 3,713,165 | 1/1973 | Langerlof et al. | 343/771 |
| 3,987,454 | 10/1976 | Epis | 343/771 |
| 3,990,079 | 11/1976 | Epis | 343/771 |
| 4,313,120 | 1/1982 | Westerman | 343/770 |

FOREIGN PATENT DOCUMENTS 852322 10/1960 United Kingdom ..... 343/771

OTHER PUBLICATIONS

Hyneman, "Closely-Spaced Transverse Slots in Rectangular Waveguide", IRE Transactions on Antennas and Propagation, Oct. 1959, pp. 335 et. seq.

Dion, "Nonresonant Slotted Arrays", IRE Transactions on Antennas and Propagation, Oct. 1958, pp. 360 et. seq.

*Primary Examiner*—Eli Lieberman

*Assistant Examiner*—Michael C. Wimer

*Attorney, Agent, or Firm*—Edward J. Radlo; Robert D. Sanborn

[57] ABSTRACT

A leaky waveguide slotted traveling wave antenna having several elongated nonresonant slots (2) oriented with their long axes substantially orthogonal to the direction of propagation within waveguide (1) filled with a dielectric material having a dielectric constant greater than 1. The length (m) of each slot (2) gradually increases as one traverses the waveguide (1) along the direction of propagation, whereas the width (W) of the wall of the waveguide (1) in which the slots (2) are cut gradually decreases as one traverses the waveguide (1) along the direction of propagation. Any angle of radiation between 0° and 135°, including endfire and broadside radiation, can be achieved. The width (w) of each slot (2) and the inter-slot spacing (d) can vary; the increase in slot length (m) can be non-uniform.

16 Claims, 2 Drawing Figures

TAPERED-WIDTH LEAKY-WAVEGUIDE ANTENNA

TECHNICAL FIELD

This invention relates to antennas, and more particularly, to slotted leaky-waveguide traveling wave antennas.

BACKGROUND ART

A prior art search disclosed the following references:

U.S. Pat. No. 3,500,251 utilizes a series of slots cut into a waveguide wall to transfer energy from one portion of an RF switch to another, wherein the slots have a gradually decreasing length as the waveguide is traversed. However, this patent teaches away from the present invention in that the waveguide tapers in the same direction that the length of the slots taper (the presence of wedge shaped dielectric 20 increases the electrical width of the waveguide), whereas in the present invention the waveguide and slots taper in opposite directions. Furthermore, the patent discloses log periodic radiators, which means that at least one slot is resonant at any particular frequency within the band of operation of the device, wherein the present invention uses slots which are solely nonresonant.

U.S. Pat. Nos. 3,530,478 and 3,633,207 show slotted waveguide antennas having slots which gradually diminish in length as one traverses the waveguide. However, in these patents the waveguide tapers in the same direction as the tapering of the slots, and furthermore, the antennas are log periodic.

U.S. Pat. No. 3,218,644 utilizes a log periodic series of slots with energy traveling between two ground planes (therefore, it is not a waveguide).

U.S. Pat. Nos. 3,987,454 and 3,990,079 are slotted waveguide antennas wherein the slots follow a log periodic function, unlike the nonresonant slots of the present invention. Furthermore, the slots are aligned with their long axes substantially parallel to the direction of propagation, rather than orthogonal thereto as in the present invention.

Hyneman, "Closely-Spaced Transverse Slots in Rectangular Waveguide", IRE Transactions on Antennas and Propagation, October, 1959, p. 335 et. seq., shows a closely spaced slotted traveling wave array. All slots have the same length, the waveguide does not taper, and the waveguide is filled with air.

Dion, "Nonresonant Slotted Arrays", IRE Transactions on Antennas and Propagation, October, 1958, p. 360 et seq, describes relationships among parameters within nonresonant slotted arrays.

DISLOSURE OF INVENTION

A slotted leaky-waveguide traveling wave antenna has slots (2) whose lengths (m) gradually increase as one traverses the waveguide (1) in the direction of wave propagation, whereas the width (W) of the waveguide (1) gradually decreases as one traverses the waveguide (1) in the direction of wave propagation. The slots (2) are arranged so that their long axes are substantially orthogonal to the direction of wave propagation. The waveguide (1) is filled with a dielectric material having a dielectric constant greater than 1. For endfire propagation, the slots (2) are spaced less than a quarter of a freespace wavelength apart. For broadside propagation the slots (2) are spaced one waveguide wavelength apart and the dielectric has a dielectric constant greater than 4.

The resulting antenna compensates for the changes of radiated beam angle associated with the change of leakage attenuation along the length of the waveguide (1), thus producing a well focused beam with low sidelobes. Fine tuning may be achieved by adjusting the width (w) of each slot (2) and the distance (d) between slots (2), and by making nonconstant the rate of change of the slot length (m).

BRIEF DESCRIPTION OF DRAWINGS

These and other more detailed and specific objects and features of the present invention are more fully disclosed in the following specification, reference being had to the accompanying drawings, in which.

BEST MODE FOR CARRYING OUT THE INVENTION

The antenna consists of waveguide 1, an elongated hollow conductive box closed by conductors on all sides and having a substantially rectangular cross-section. The length of waveguide 1 is L, its width at any given point is W, and its thickness is T. Electromagnetic energy, typically at microwave frequencies, is fed into waveguide 1 at its left end via connector 3, which is shown as a coax-to-waveguide connector. The center conductor of the coax connector makes contact with the wall of waveguide 1 opposite from which it protrudes if T is small compared with W.

Waveguide 1 tapers gradually and preferably uniformly as one traverses it along the direction of propagation of the wave of electromagnetic energy carried within it (from left to right in the Figures), so that the width of waveguide 1 is W1 at the left and W2 at the right. Waveguide 1 is filled with a dielectric substance having a dielectric constant greater than 1.

Figure 1:
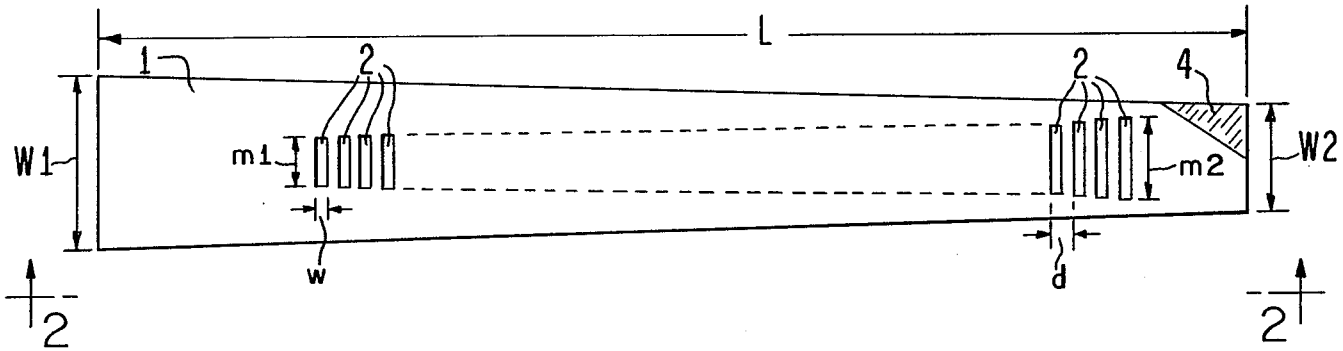
FIG. 1 (not drawn to scale) is a top plan view of an antenna made according to the teachings of the present invention.
Figure 2:
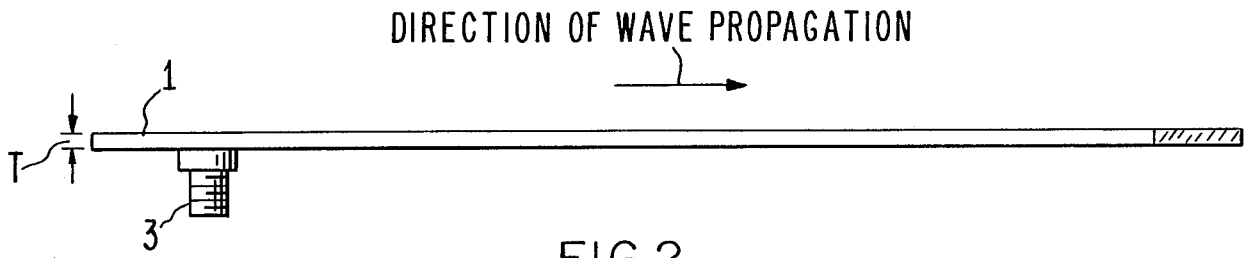
FIG. 2 is a side view of the antenna of FIG. 1 viewed along lines 2—2 of that Figure.

Several substantially rectangular, elongated slots 2, preferably oriented with their long axis orthogonal to the direction of wave propagation, are cut into one of the two wide walls of waveguide 1. These slots 2 each allow a portion of the energy to escape waveguide 1 as the wave travels from left to right, thereby permitting the desired radiation of the energy into the surrounding space, centered in the plane which includes the longitudinal centerline of waveguide 1 and which is orthogonal to the plane of the wide walls of waveguide 1. The dotted lines in FIG. 1 signify that slots 2 are cut into the waveguide wall throughout the entire region of the dotted lines.

The length of each slot, designated by the letter m, increases (not necessarily uniformly) as one traverses waveguide 1 in the direction of wave propagation. Thus m1, the length of the leftmost slot, is less than m2, the length of the rightmost slot. Note that the slot lengths m increase in a direction opposite to the direction of increase of the width of waveguide 1.

At the terminating right hand end of waveguide 1 can be situated an absorptive wedge 4, which absorbes excess energy that has not been radiated from the antenna by the slots 2. Wedge 4 should have a gradually increasing thickness along the direction of propagation so that it absorbs said excess energy gradually without presenting any abrupt surfaces that could undesiredly reflect back portions of said excess energy into the radiating portion of waveguide 1. Alternatively, waveguide 1 could terminate in a non-dissipative load such as is described in my U.S. patent application Ser. No. 184,598, filed Sept. 5, 1980, now U.S. Pat. No. 4,313,120, which is a continuation of U.S. Ser. No. 062,087, filed July 30, 1979, now abandoned.

To achieve endfire radiation, the spacing d between each pair of slots 2 is less than $\lambda/4$, where $\lambda$ is the freespace wavelength of the electromagnetic energy fed into the antenna. None of the slots 2 are resonant at any operating frequency of the antenna. Resonance here means that a slot is an integral number of half $\lambda_S$'s in length, where $\lambda_S$ is the equivalent slot wavelength; its value is between that of the dielectric wavelength (the wavelengh taking into account the presence of just the dielectric) and the freespace wavelength.

This slot spacing also can accommodate angles of radiation between 0° (endfire) and 45°, where the angle of radiation is defined as the angle made between the major lobe of the radiated energy and the direction of wave propagation within waveguide 1.

For broadside radiation (i.e., angle of radiation=90°), the slots are spaced $d=\lambda_G$ apart, where $\lambda_G$, the waveguide wavelength, takes into account the presence of the dielectric, the presence of slots 2, and the width of waveguide 1. When this spacing is used, the dielectric must have a dielecric constant greater than 4 to avoid secondary beams.

In each of the above cases, the angle of radiation can be varied by scanning the frequency of the energy fed into the antenna and/or by varying the width W of the waveguide 1. The antenna can be used to scan 45° from either endfire or broadside beam position by using a scanning bandwidth of approximately 10 percent frequency variation; in the case of the broadside spacing, the scanned beam can be formed on either side of the broadside axis.

The antenna described herein is superior to prior art antennas in terms of its supression of sidelobes and narrowness of beam. A theoretical reason for this is that in addition to having a symmetrically tapered (or if not, a uniform) voltage distribution along the length of the antenna, the wave velocity along the length of the antenna also remains constant. This voltage distribution can be achieved by utilizing longer slots as one traverses the waveguide along the direction of propagation. This implies that the series inductive loading introduced into the waveguide by the slots becomes greater as one traverses the waveguide, which slows the propagating wave an increasing amount. A constant wave velocity along the waveguide is accomplished by tapering the width of the waveguide in the direction of propagation, which has the effect of speeding up the wave to compensate for the increased slot lengths.

In designing such an antenna, one can first select the number of slots 2. The more slots, the narrower the radiated beam. Then W can be selected. In the absence of slots, $W=\lambda/2\sqrt{E\text{-}\cos^2\theta}$, where E is the dielectric constant and $\theta$ is the angle of radiation that is desired. In the presence of slots, W must decrease slightly to maintain a given angle $\theta$. The longer the slot length m, the more W must decrease to achieve the desired characteristics. W1 and W2 are selected partially analytically and partially empirically.

Then T is selected. In general, decreasing T increases the amount of radiation from each slot. As a normal rule of thumb, $0.05<T/W<0.4$.

Then the length of slots 2 is chosen as follows: First, the desired sidelobe level is ascertained. Then the desired voltage distribution is determined; this distribution is partially but not totally dependent upon the desired sidelobe level. Then a curve of attenuation due to radiation A is derived as a function of distance along waveguide 1, where A is measured in decibels per freespace wavelength. The length m of each slot 2 is empirically and/or analytically selected to give this attenuation. Finally, the width of each slot w is chosen; normally w is approximately m/10. The selected slot spacing d depends upon both the desired angle of radiation, as described above, and the attenuation A.

An antenna according to the above teachings was constructed at X-band ($\lambda$ approximately equal to 1.26 inches) using printed circuit techniques. Endfire radiation was employed. Dimensions for this antenna were as follows: W1 was 0.530 inches, W2 was 0.490 inches with a uniform taper from W1 to W2 along waveguide 1. L was 15.92 inches, with most of this length slotted. The number of slots was 149. m1 was 0.220 inches and m2 was 0.270 inches, with m uniformly increasing from left to right. w of each slot was 0.025 inches and d was 0.1 inch. T was 0.062 inches.

The desired radiation characteristics of the antenna can be fine tuned by noting that minor influences on W, in order of importance, are m, d, and w. Thus, one may vary m in such a way that there is a nonuniform rate of increase in m as one traverses waveguide 1 (W is normally made to taper uniformly for mechanical reasons). As m increases for a given slot, A also increases for that slot.

w and d can be made to vary from slot to slot. Generally, as w increases, A at that slot also increases; as d increases, A in that region decreases.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A slotted waveguide antenna comprising:

an elongated hollow conductive waveguide having two ends and two elongated faces, one end being fed with electromagnetic energy which then propagates along within the waveguide towards its other ends;

cut out of one of the faces, several elongated slots each having its long axis substantially orthogonal to the long axis of the waveguide;

wherein the width of the slotted face decreases as the waveguide is traversed in the direction of transmitting propagation; and the length of the slots increases as the waveguide is traversed in the direction of transmitting propagation; wherein the antenna has been fabricated by selecting slot length that give a desired sidelobe pattern; and the width variations of the slotted face have been selected to compensate for changes in wave propagation velocity caused by the variable slot lengths, in such manner that the wave propagation velocity is kept substantially constant along the length of the waveguide.

2. Antenna of claim 1 wherein none of the slots are resonant at an operating frequency of the electromagnetic energy fed into the antenna.

3. Antenna of claim 1 wherein the waveguide is filled with a dielectric material having a dielectric constant greater than one.

4. Antenna of claim 1 wherein the slots are spaced less than a quarter of a freespace wavelength apart.

5. Antenna of claim 1 wherein the slots are spaced approximately one waveguide wavelength apart; and the waveguide is filled with a dielectric material having a dielectric constant greater than four.

6. Antenna of claim 1 wherein the slots do not all have the same width.

7. Antenna of claim 1 in which the spacing between adjacent slots is not the same for all pairs of slots.

8. Antenna of claim 1 in which the slot lengths increase nonuniformly as the waveguide is traversed in the direction of transmitting propagation.

9. Antenna of claim 1 in which the width of the slotted face decreases uniformly along the direction of transmitting propagation.

10. Method of constructing a multi-slotted elongated waveguide antenna so as to produce low sidelobes, said method comprising the steps of:

choosing a desired sidelobe level;

selecting a desired voltage distribution that is dependent upon the chosen sidelobe level;

deriving from said voltage distribution a profile of attenuation due to radiation as a function of distance along the waveguide;

making the initial width of the waveguide equal to $\lambda/2\sqrt{E\text{-}\cos^2\theta}$ where $\lambda$ is the freespace wavelength of electromagnetic energy fed into the antenna, E is the dielectric constant of a dielectric that fills the waveguide, and $\theta$ is the desired angle, with respect to the long waveguide axis, of the radiation emanating from the antenna;

selecting slot lengths to give the derived attenuation profile, wherein the slot lengths increase along the waveguide in the direction of transmitting energy propagation; and decreasing the width of the waveguide along the direction of transmitting propagation to compensate for changes in wave propagation velocity caused by the variable slot lengths, in such manner that the wave propagation velocity is kept substantially constant along the length of the waveguide.

11. Method of claim 10 wherein the following additional step is performed:

varying the slot widths

12. Method of claim 10 further comprising the steps of:

filling the waveguide with a dielectric material having a dielectric constant greater than unity;

spacing the slots less than a quarter of a freespace wavelength apart from each other; and producing a radiated beam of electromagnetic energy that makes an angle with respect to the long waveguide axis having a range of 0° to 45°, by means of varying the frequency of the input energy.

13. Method of claim 10 further comprising the steps of:

filling the waveguide with a dielectric material having a dielectric constant greater than four;

spacing the slots approximately one waveguide wavelength apart from each other; and producing a radiated beam of electromagnetic energy that makes with respect to the broadside axis an angle having a range of ±45°, by means of varying the frequency of the input energy.

14. The method of claim 10 further comprising the additional step of varying the inter-slot spacings.

15. The method of claim 10 further comprising the additional step of increasing the slot lengths nonuniformly along the direction of transmitting propagation.

16. The method of claim 10 wherein the waveguide width decreases uniformly along the direction of transmitting propagation.

* * * * *